United States Patent [19]

Nagayama

[11] 4,364,059

[45] Dec. 14, 1982

[54] INK JET PRINTING APPARATUS

[75] Inventor: Haruhiko Nagayama, Tokyo, Japan

[73] Assignee: Ricoh Company, Ltd., Tokyo, Japan

[21] Appl. No.: 214,387

[22] Filed: Dec. 8, 1980

[30] Foreign Application Priority Data

Dec. 17, 1979 [JP] Japan ..... 54-163808
Dec. 17, 1979 [JP] Japan ..... 54-163809

[51] Int. Cl.[3] ..... G01D 15/18
[52] U.S. Cl. ..... 346/75; 346/140 R
[58] Field of Search ..... 346/75, 140 R, 140 IJ, 346/140 PD

[56] References Cited

U.S. PATENT DOCUMENTS 4,152,710 5/1979 Matsuba et al. ..... 346/140 IJ
4,153,901 5/1979 White et al. ..... 346/140 IJ X
4,187,512 2/1980 Matsunaga et al. ..... 346/75 X
4,190,846 2/1980 Yamamoto et al. ..... 346/75 X

*Primary Examiner*—G. Z. Rubinson
*Assistant Examiner*—W. J. Brady
*Attorney, Agent, or Firm*—David G. Alexander

[57] ABSTRACT

Ink is recirculated from a reservoir (624) through an ink ejection head (100) and back to the reservoir (624) while it is being heated prior to actual printing to purge air from the ink and prevent erroneous ejection. The heat (100) has a nozzle assembly formed of a thick glass plate (184') and a thin plate (190') of monocrystalline silicone which is bonded to the glass plate (184'). Ink ejection ports (191') are etched through the silicone plate (190') which communicate with an ink chamber of the head (100) through passageways (185') formed through the glass plate (184').

12 Claims, 40 Drawing Figures

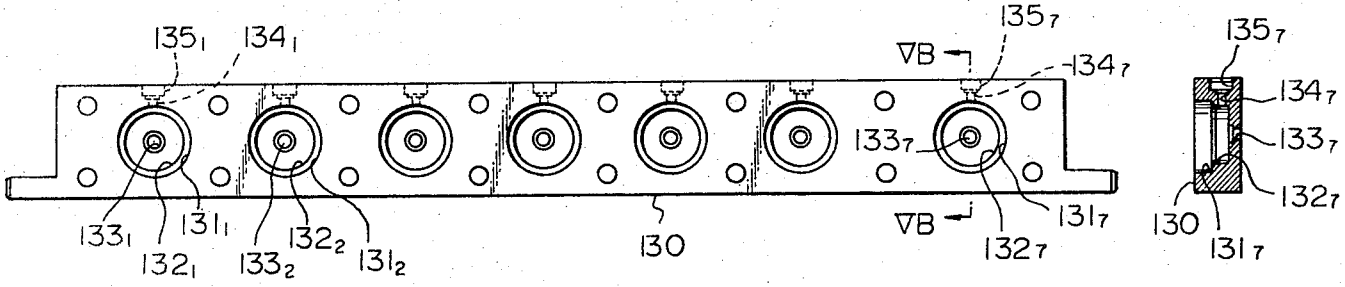
Fig. 5b
Fig. 5a
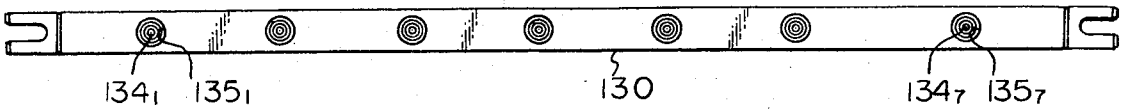
Fig. 5c

INK JET PRINTING APPARATUS

BACKGROUND OF THE INVENTION

The present invention relates to a deflection control type ink jet recording or printing apparatus which ejects pressurized ink, imparts vibration to the ejected ink to regularly form droplets of ink, selectively develops a charging electric field during the formation of ink droplets on the basis of image signals, charges ink droplets with this electric field, and deflects the charged ink droplets with a deflecting electric field. More particularly, the present invention is concerned with a multi-nozzle, deflection control type ink jet recording apparatus having a number of ejection ports arranged linearly.

An ink jet recording apparatus of the type described is available in three different systems: a two-value deflection control system, a multi-value deflection control system and a combined system of the two. In the two-value system, droplets of ink to record information are charged (or charged to a high level) while non-recording ink droplets are left non-charged (or charged to a low level or an opposite polarity) so that the recording droplets are deflected to a large extent by a deflecting electric field and caused to impinge on a copy sheet with the non-recording droplets captured by a gutter. Conversely, the non-recording droplets may be deflected to a large extent and captured by a gutter. With this type of system, one ink jet nozzle is provided for recording one picture element. Concerning the multi-value system, one nozzle is provided for recording three or more picture elements (e.g. 40 dots along a width of 5 mm in the case of 8 dots/mm for instance) and ink droplets are charged to three or more levels (40 levels for example) and deflected along three or more paths (40 paths for example). In the combined system, charging is performed in the same way as in the multi-value system while charged recording droplets are deflected by a deflecting electric field extending in the Y-axis direction to clear a gutter and then deflected by a deflecting electric field in the X-axis direction in accordance with the charge level. This records information with positional differences along the X-axis direction on a recording sheet.

Meanwhile, ink ejected from a nozzle can be vibrated by any one of three different methods: a method which applies pressure vibration to ink itself, a method for applying vibration to a nozzle plate which defines an ejection port in the ink ejecting direction, and a method for causing the head to bodily vibrate in the ink ejecting direction. The first method is achievable with an arrangement wherein a nozzle plate having one ejection port is bonded to the front end of a cylindrical electrostrictive vibrator with the other end being communicated with a pressurized ink supply box or chamber. Another possible arrangement for the first method utilizes a slitted port formed through the front wall of a pressurized ink supply box, a nozzle plate having numerous ejection ports and being bonded to the ink supply box in such a manner as to cover the slitted port, and one or more flat electrostrictive vibrators mounted to one side wall of the ink supply box, the individual elements cooperating to impart a vibrating pressure to ink inside the box. For the second method, a porous nozzle plate may be secured through an elastic material to a pressurized ink supply box and caused to vibrate by an electrostrictive vibrator. For the third method, the head itself may be vibrated by a motor, a solenoid device, an electrostrictive vibrator or the like.

In a deflection control type ink jet recording apparatus employing any one of such known systems, the distance between the nozzle plate and recording sheet is relatively long. Therefore, the ink pressure is set at a high level so that an ink particle safely reaches the recording sheet while describing a stable path despite the actions of the charging electric field and deflecting electric field. Meanwhile, there must be determined a viscosity of the ink and a velocity of the ejected ink in order that ink droplets of a selected size are formed regularly and deposited with predetermined amounts of charge at a precise timing. When the ink pressure is at a given desired level, the viscosity and velocity are dependent on the temperature of the ink. Accordingly, the ink temperature should preferably be maintained constant to always promote stable recording against possible changes in the ambient or room temperature. For this purpose, ink is heated to a selected level in consideration of the level of the room temperature.

In this way, ink is pressurized and heated immediately before a recording operation begins. After the pressure and temperature of ink have reached and stabilized within predetermined ranges, charging voltage (pulse) and phase relative to a droplet separating phase, or vice versa, are set (phase search) and then a recording operation is started.

Pressurizing and heating ink just before a start of recording gives rise to a problem, however. At the instant communication is established between a source of pressurized ink supply and an ejection head to start the supply of ink under pressure to the ejection head, tiny droplets of ink are discharged as a spray from individual ejection ports and scattered therearound contaminating the charging electrode and various elements adjacent to the charging electrode. Moreover, such tiny droplets even though non-charged may happen to impinge on and contaminate a recording sheet as a result of disturbance of the predetermined paths. The cause of this phenomenon is as follows. While the apparatus is inoperative with the head disconnected from the pressurized ink source, atmospheric pressure prevails in an ink chamber communicating with ink ejection ports and this admits atmospheric air into the ejection ports and ink chamber in combination with the outflow of ink through the ejection ports. Additionally, while ink in the ink chamber is static, air contained in the ink is separated therefrom and floats upwardly to an upper part of the ink chamber. Air also stays in the ejection ports communicated with the ink chamber. When heated and pressurized ink is supplied to the ink chamber of the thus conditioned head, air inside the chamber is partly discharged through the ejection ports together with the ink forming an ink spray outside the head. This occurs repeatedly in a continuous and intermittent manner until air inside the ink chamber is sufficiently dissipated. As the temperature of the ink within the ink chamber rises, air inside the ink chamber expands until, at a certain time, the ink is sprayed out all of a sudden. Hence, a sufficiently long period of time is needed before a phase search or a start of recording can begin.

Ink ejection heads of the type described generally employ one of three different systems. A head acording to a first system is supplied with pressurized ink into its ink chamber and ejects the ink continuously due to the ink pressure (e.g. a deflection control type ink jet head). A second system known as an ink-on-demand system supplies an ink chamber of a head with non-pressurized ink and causes the head to eject the ink intermittently by applying a pulsating pressure produced by pulsating drive of an electrostrictive vibrator to the ink. A third system causes a head to eject ink by applying a sucking electric field to ink present at its ejection port. In any of such systems the ink ejection port takes the form of a minute opening (circular or rectangular) or a slit. Where a head thus constructed is used for printing operation with ink, the ink ejection characteristics such as the size of ink droplets and ejection velocity vary with the viscosity of ink which in turn varies with the temperature if the quality of the ink is the same. Therefore, the temperature of the ink is generally maintained constant so that the viscosity may remain constant. This is achievable by heating the ink to a certain level of temperature.

While the minute ink ejection port is formed through a metal or non-metal plate, the port must be formed with accuracy because its shape is another factor which affects the ink ejection characteristics of a head. Etching is a preferred method of forming such an ink ejection head with accuracy. Materials which can be etched to prepare nozzle plates include thin plates of silicone, ruby, sapphire and like monocrystalline materials and thin plates of monocrystalline metals. Conventionally, a nozzle plate in the form of a usual thin plate of metal or monocrystalline silicone formed with an ink ejection port is securely connected to a member having a liquid chamber therein by welding, brazing or cementing. The member with a liquid chamber is usually formed of stainless steel or like metal which is corrosion-resistant against ink. In such a conventional ink ejection head, it is difficult to machine that surface of the liquid chamber member to be engaged by the nozzle plate into a flat surface with precision. The nozzle plate therefore tends to be deformed or broken when connected to the liquid chamber member. Breakage is particularly liable to occur when the nozzle plate comprises a multi-nozzle, mirror-finished thin plate of monocrystalline silicone or like non-metallic material having a plurality of ink ejection ports. Since the nozzle plate bonded to the liquid chamber member cannot maintain its flat position with accuracy, the individual ejection ports of the multi-nozzle are oriented in various ejection directions which prevents images of good quality from being reproduced with the ink. Furthermore, the temperature of the ink differs a great deal from the operative condition of the apparatus to the inoperative condition because the ink is heated during the recording operation. Such a temperature difference causes the liquid chamber member and nozzle plate to expand and contract differently from each other due to their different coefficients of thermal expansion, resulting also in the deformation and/or breakage of the nozzle plate.

SUMMARY OF THE INVENTION

An ink jet printing apparatus embodying the present invention includes an ink ejection head having a chamber therein and at least one ink ejection port communicating with the chamber, an ink reservoir for containing ink and pump means for pumping ink from the reservoir to the chamber, and is characterized by comprising a passageway communicating with the chamber, and valve means disposed in the passageway.

The ink ejection head includes a block defining therein an ink chamber and being formed with a flat surface having a plurality of ink ejection passageways formed therethrough which communicate with the ink chamber, a thick flat plate being formed with ink ejection passageways therethrough conjugate to the pasageways of the flat surface, a thin flat plate fixed to the thick flat plate being formed with ink ejection ports therethrough conjugate to the ink ejection ports of the thick flat plate and fastener means for fastening the thick flat plate to the flat surface with the respective ink ejection passageways in alignment, a coefficient of thermal expansion of the thick flat plate being equal to a coefficient of thermal expansion of the thin plate.

In accordance with the present invention, ink is recirculated from a reservoir through an ink ejection head and back to the reservoir while it is being heated prior to actual printing to purge air from the ink and prevent erroneous ejection. The head has a nozzle assembly formed of a thick glass plate and a thin plate of monocrystalline silicone which is bonded to the glass plate. Ink ejection ports are etched through the silicone plate which communicate with an ink chamber of the head through passageways formed through the glass plate.

It is an object of the present invention to avoid spraying of ink just after the supply of pressurized ink.

Another object of the present invention is to provide a deflection control type ink jet printing or recording apparatus which minimized contamination of its nozzle plate and elements adjacent thereto.

Another object of the present invention is to provide a deflection control type ink jet recording apparatus which needs only a short start-up time before recording operation.

Another object of the present invention is to provide a deflection control type, high density ink jet recording apparatus which is capable of simultaneous multi-point recording such as 1-line recording.

Another object of the present invention is to provide an ink ejection head which minimizes deformation and breakage of a nozzle plate during assemblage.

Another object of the present invention is to provide an ink ejection head which can hold a nozzle plate in an accurately flat position.

Another object of the present invention is to provide a multi-nozzle ink ejection head whose ejection ports are regularly oriented.

In order to achieve these objects, an ink ejection head according to the present invention includes a nozzle plate, preferably a thin plate of silicone or like non-metallic monocrystalline structure, and a flat plate which has a coefficient of thermal expansion equivalent to that of the nozzle plate and has its surfaces finished with accuracy. The nozzle plate is bonded to one surface of the flat plate and this flat plate is securely connected at the other surface to a liquid chamber member. Where the nozzle plate is in the form of a thin plate of monocrystalline silicone, the flat plate preferably comprises a plate of glass, ceramic or like non-metallic material. The flat plate needs to be air-tightly connected to the liquid chamber member. This connection should preferably be made through an elastic member typified by an O-ring, packing or resinous sealing.

It is another object of the present invention to provide a generally improved ink jet printing apparatus.

Other objects, together with the foregoing, are attained in the embodiments described in the following description and illustrated in the accompanying drawing.

BRIEF DESCRIPTION OF THE DRAWING

FIG. 5*a* shows a filter bracket in a rear view with respect to the direction of ink ejection;

FIG. 5*b* is a section along a line VB—VB of FIG. 5*a;*

FIG. 5*c* is a plan view of the filter bracket;

DESCRIPTION OF THE PREFERRED EMBODIMENTS

While the ink jet printing apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
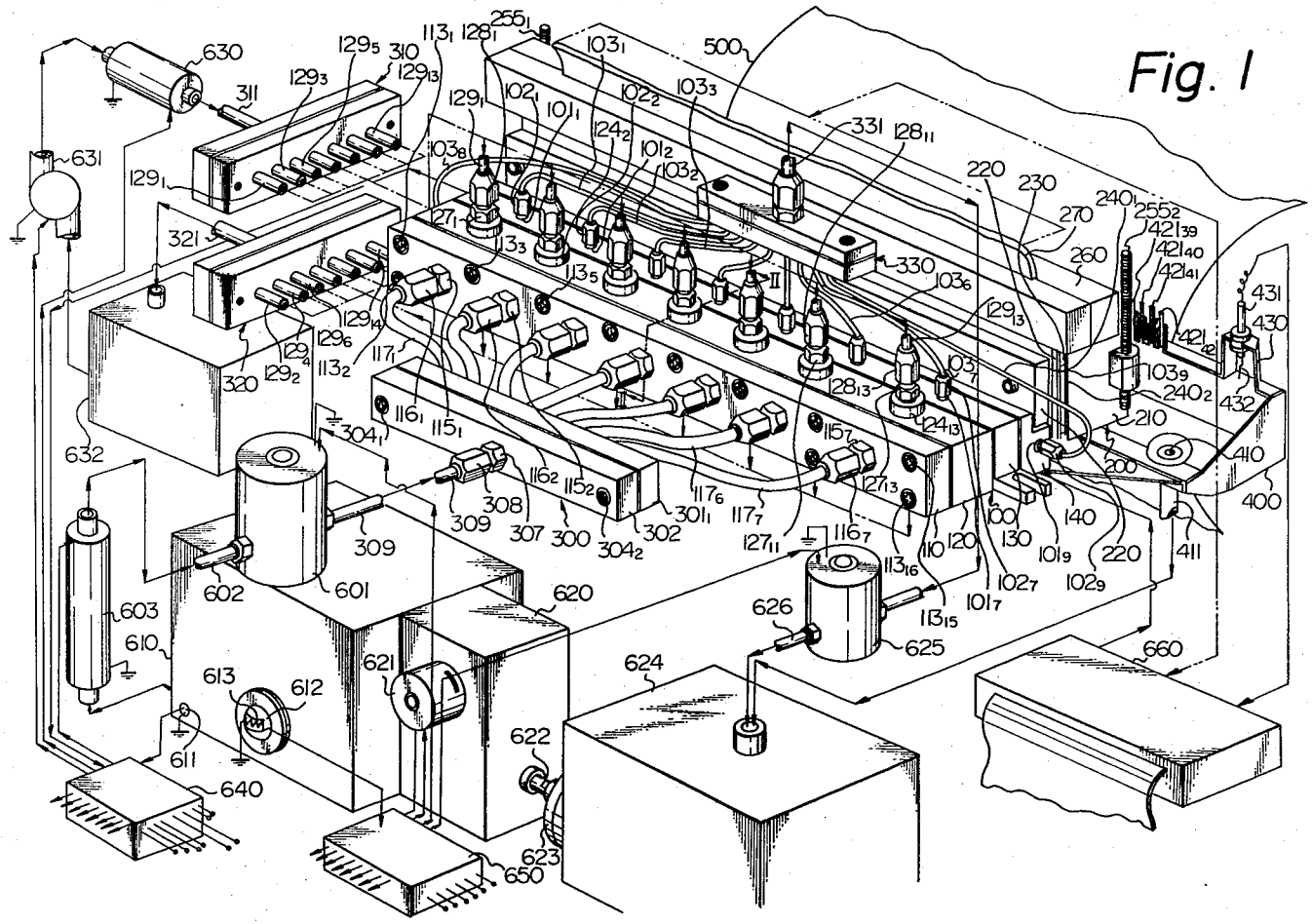
FIG. 1 shows in perspective a preferred embodiment of the present invention.
Figure 2:
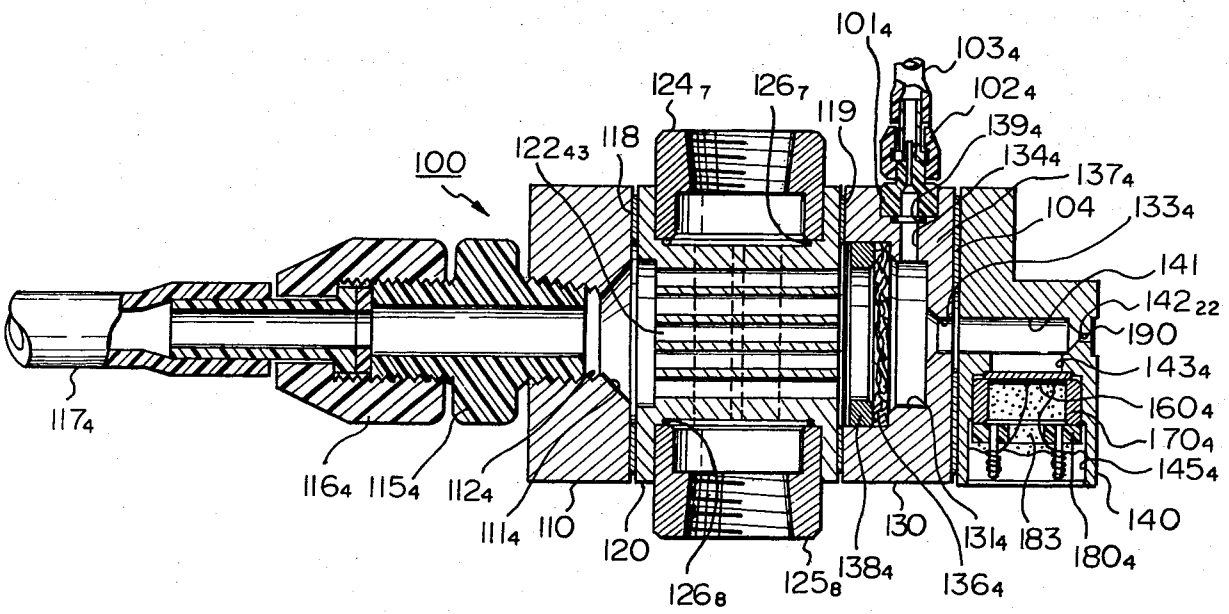
FIG. 2 is a fragmentary section taken along a line II—II of FIG. 1.
Figure 3A:
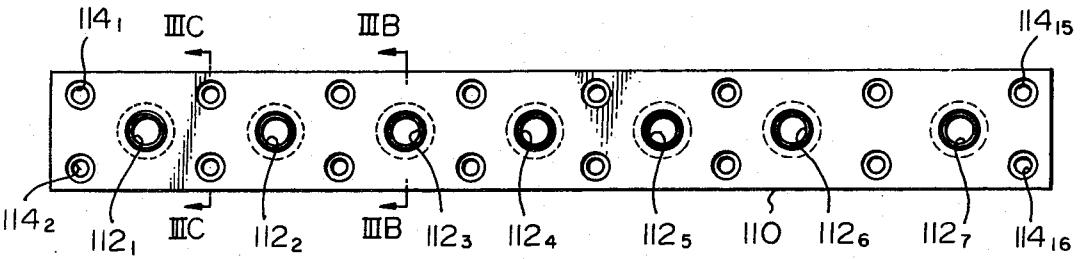
FIG. 3*a* is a rear view of an inlet block with respect to an intended direction of ink ejection.
Figure 3C:
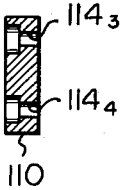
FIGS. 3*b* and 3*c* are sections along lines IIIB—IIIB and IIIC—IIIC of FIG. 3*a*, respectively.
Figure 3B:
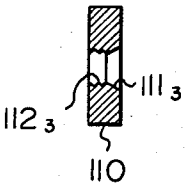

Referring to FIG. 1, there is shown a deflection control type ink jet printing or recording apparatus according to the present invention. The apparatus includes an ink ejection head generally designated by the reference numeral 100 which is shown in section in FIG. 2 taken along a line II—II of FIG. 1. The head 100 is generally made up of an inlet block 110, a heat-exchanger block 120, a filter bracket 130 and a body 140. The inlet block 110 is shown in plan view in FIG. 3*a*, in section along a line IIIB—IIIB of FIG. 3*a* in FIG. 3*b* and in section along a line IIIC—IIIC of FIG. 3*a* in FIG. 3*c*. The inlet block 110 has seven tapered bores $\mathbf{111}_1$–$\mathbf{111}_7$ and tapered screw-threaded bores $\mathbf{112}_1$–$\mathbf{112}_7$ contiguous with the individual tapered bores. The inlet block 110 also has sixteen through bores $\mathbf{114}_1$–$\mathbf{114}_{16}$ adapted to receive screws $\mathbf{113}_1$–$\mathbf{113}_{16}$ for fastening the four members 110–140 of the head 100 together. Hollow plastic screws $\mathbf{115}_1$–$\mathbf{115}_7$ have one end screwed in the individual threaded bores $\mathbf{112}_1$–$\mathbf{112}_7$ of the inlet block 110 while coupling screws $\mathbf{116}_1$–$\mathbf{116}_7$ are fastened to the other end of the hollow screws $\mathbf{115}_1$–$\mathbf{115}_7$. Pipes $\mathbf{117}_1$–$\mathbf{117}_7$ extend from the individual coupling screws $\mathbf{116}_1$–$\mathbf{116}_7$ to a manifold member 300 so as to communicate the tapered bores $\mathbf{111}_1$–$\mathbf{111}_7$ of the inlet block with the manifold member 300. The tips of the screws $\mathbf{113}_1$–$\mathbf{113}_{16}$ are screwed in the body 140 of the head 100 so that the inlet block 110 is securely engaged with the heat-exchanger block 120 through a packing 118.

Figure 4B:
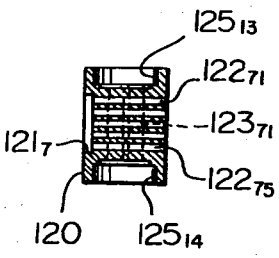
FIG. 4*b* is a section along a line IVB—IVB of FIG. 4*a;*
Figure 4A:
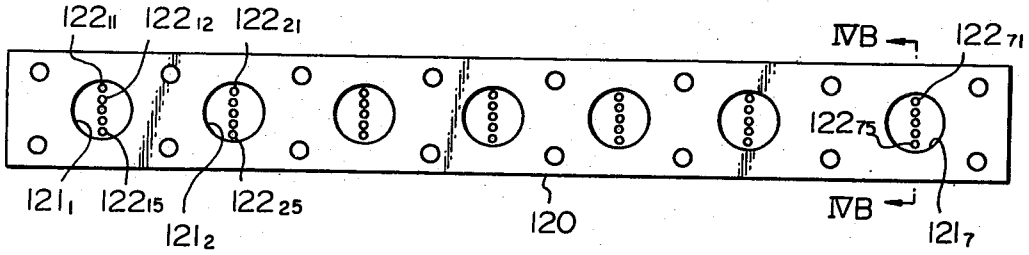
FIG. 4*a* is a rear view of a heat-exchanger block with respect to the direction of ink ejection.
Figure 4C:
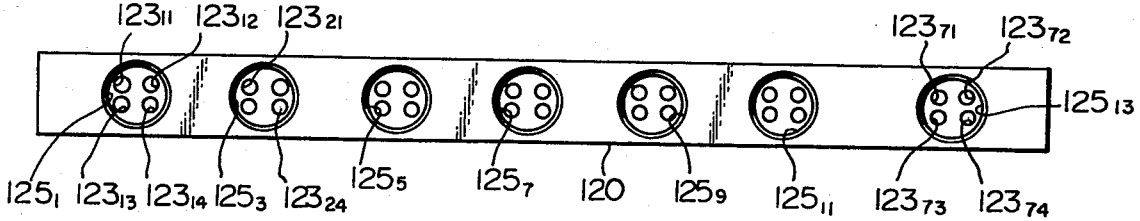
FIG. 4*c* is a plan view of the block.

The heat exchanger block 120 has a construction shown in plan view in FIG. 4*a*, in section along a line IVB—IVB of FIG. 4*a* in FIG. 4*b* and in plan view in a plane perpendicular to the plane of FIG. 4*a* in FIG. 4*c*. Seven circular recesses $\mathbf{121}_1$–$\mathbf{121}_7$ are formed in the block 120 in alignment with the tapered bores $\mathbf{111}_1$–$\mathbf{111}_7$ of the block 110. Thirty-five through bores $\mathbf{122}_{11}$–$\mathbf{122}_{75}$ for ink passage extend from the recesses $\mathbf{121}_1$–$\mathbf{121}_7$ (a set of five through bores 122 extend from each recess 121). In positions adjacent to yet outside the through bores $\mathbf{122}_{11}$–$\mathbf{122}_{75}$, twenty-eight through bores $\mathbf{123}_{11}$–$\mathbf{123}_{74}$ extend perpendicular to the through bores 122 to permit the flow of a heat-exchanging liquid therethrough. These through bores 123 terminate individually at the bottoms of blind bores 125 of the block 120. O-rings $\mathbf{126}_1$–$\mathbf{126}_{14}$ are placed in the respective blind bores 125 and then members $\mathbf{124}_1$–$\mathbf{124}_{14}$ are press-fitted in the blind bores individually. The members $\mathbf{124}_1$–$\mathbf{124}_{14}$ have tapered and threaded through bores in which hollow screws $\mathbf{127}_1$–$\mathbf{127}_{14}$ have one end screwed. Coupling screws $\mathbf{128}_1$–$\mathbf{128}_{14}$ are fastened to the other ends of the hollow screws 127. Pipes $\mathbf{129}_1$–$\mathbf{129}_{14}$ extend from the individual coupling screws 128 to manifold members 310 and 320 so that each of the through bores 123 is communicated at one end with the manifold member 310 and at the other end with the manifold member 320. More specifically, the upper ends of the through bores 123 are communicated with the manifold member 310 by the pipes 129 connected with the upper coupling screws $\mathbf{128}_1$, $\mathbf{128}_3$, $\mathbf{128}_5$ . . . $\mathbf{128}_{13}$ whereas the lower ends of the through bores 123 are communicated with the manifold member 320 by the pipes 129 connected with the lower coupling screws $128_2$, $128_4$, $128_6$ . . . $128_{14}$. The heat-exchanger block 120 thus constructed is securely engaged with the filter bracket 130 through a packing 119. The filter bracket 130 is shown in rear elevation in FIG. 5*a* with respect to an intended direction of ink ejection. FIG. 5*b* is a section along a line VB—VB of FIG. 5*a* and FIG. 5*c* is a plan view. The filter bracket 130 has an array of circular recesses $131_1$–$131_7$, circular bores $132_1$–$132_7$ contiguous with and smaller in diameter than the recesses $131_1$–$131_7$ and openings $133_1$–$133_7$ contiguous with the bores $132_1$–$132_7$ individually. The recesses $131_1$–$131_7$ and bores $132_1$–$132_7$ will hereinafter be referred to as filtering chambers and generally designated by the reference numerals $131_1$–$131_7$ are for convenience. These filtering chambers $131_1$–$131_7$ are in registry and communication with the sets of the through bores ($122_{11}$–$122_{15}$), ($122_{21}$–$122_{25}$) . . . ($122_{71}$–$122_{75}$) individually. Passageways $134_1$–$134_7$ provide communication between the individual filtering chambers $132_1$–$132_7$ and recesses $135_1$–$135_7$ which are located on top of the bracket 130. The filtering chambers 131 individually have disc-shaped filters $136_1$–$136_7$ of 2–3 μm mesh therein. Rings $138_1$–$138_7$ with O-rings $137_1$–$137_7$ are press fitted in the filtering chambers from over the filters 136. O-rings $139_1$–$139_7$ are placed in the bottoms of the individual recesses 135 on top of the bracket 130 while hollow screws $101_1$–$101_7$ are press fitted in the recesses 135 at one end. Coupled with the other end of the hollow screws 101 are coupling screws $102_1$–$102_7$ which connect to pipes $103_1$–$103_7$ at the other end thereof. The pipes $103_1$–$103_7$ extend from the associated coupling screws $102_1$–$102_7$ to a manifold member 330. The filter bracket 130 thus constructed is connected through a packing 104 to the body 140 of the head 100.

Figure 6A:
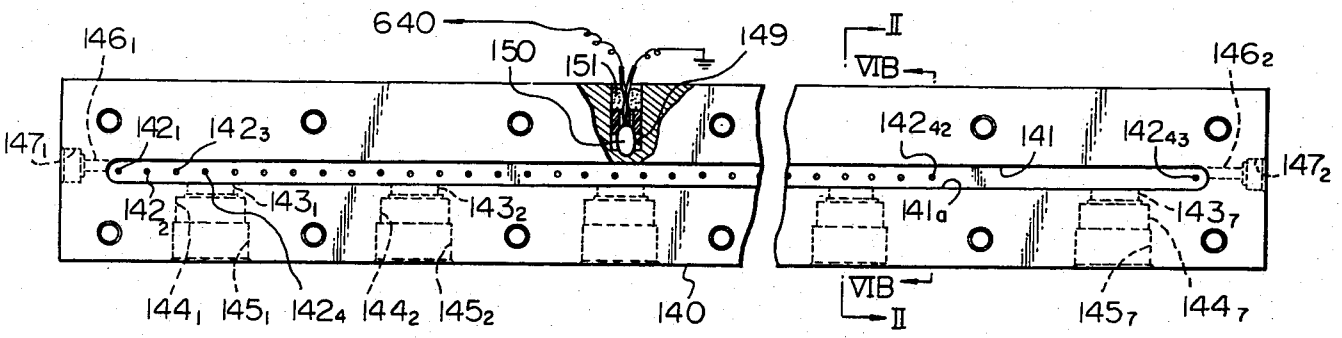
FIG. 6*a* shows a body in a rear view with respect to the direction of ink ejection.
Figure 6B:
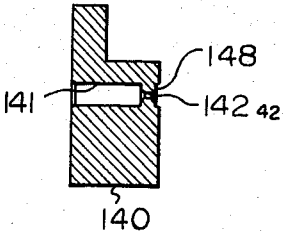
FIG. 6*b* is a section along a line VIB—VIB of FIG. 6*a;*
Figure 6C:
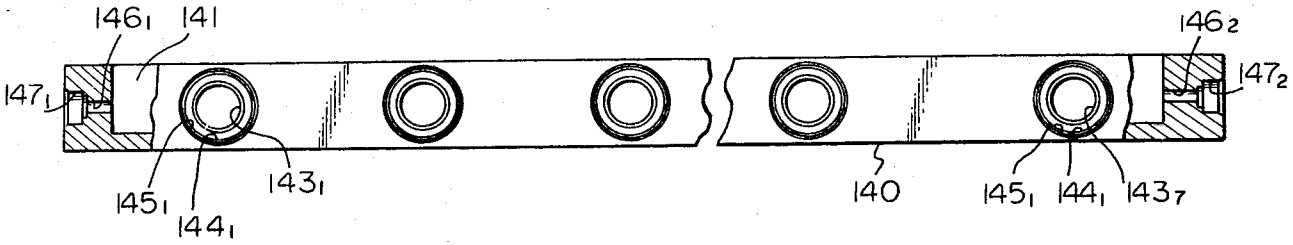
FIG. 6*c* is a bottom plan view of the body.
Figure 6E:
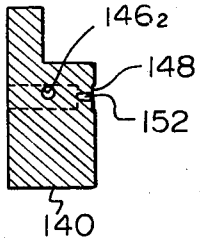
FIG. 6*e* is a section along a line VIE—VIE of FIG. 6*d;*
Figure 6D:
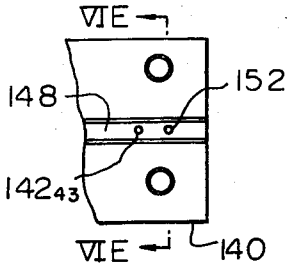
FIG. 6*d* is a fragmentary enlarged front view of the body.

The body 140 is shown in elevation in FIG. 6*a*, in section along a line VIB—VIB of FIG. 6*a* in FIG. 6*b* and in bottom plan view in FIG. 6*c*. The body 140 has an elongate slot 141 communicating with all of the openings 133 of the filter bracket 130, and forty-three branch passageways $142_1$–$142_{43}$ extending throughout the body 140 from the slot 141 to the front end of the body 140. The body 140 is bored downward at seven locations from the lower wall 141*a* of the slot 141 so as to define circular chambers $143_1$–$143_7$ for propagation of vibratory pressure, chambers $144_1$–$144_7$ contiguous with the chambers $143_1$–$143_7$ and adapted to contain electrostrictive vibrators, and openings $145_1$–$145_7$ contiguous with the chambers $144_1$–$144_7$ to permit leads to extend therethrough to the outside of the body 140. Passageways $146_1$ and $146_2$ extend transversely from upper portions of the opposite ends of the slot 141 and connect individually to bores $147_1$ and $147_2$ for press-fitting of hollow screws and, for this purpose, open at opposite lateral ends of the body 140. An elongate slot 148 extends in the front end of the body 140 along the transversely aligned front ends of the passageways $142_1$–$142_{42}$ in order to receive a nozzle plate therein. The body 140 also has a blind bore 149 which extends to a position short of the slot 141 and at the center of a line connecting the passageways $142_1$–$142_{42}$. A thermistor 150 is disposed in the blind bore 149 and sealed therein by an adhesive 151. FIG. 6*d* shows the front end of the body 140 while FIG. 6*e* shows the body in a section along a line VIE—VIE of FIG. 6*d*. The reference numeral 152 in these drawings denotes a blind hole (pin hole) which neighbors the passageway $142_{43}$ and functions in positioning a nozzle plate.

Figure 7A:
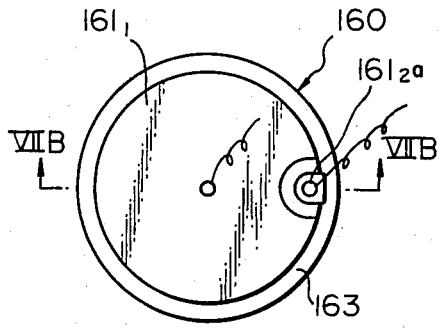
FIG. 7*a* is a plan view of an electrostrictive vibrator.
Figure 7B:
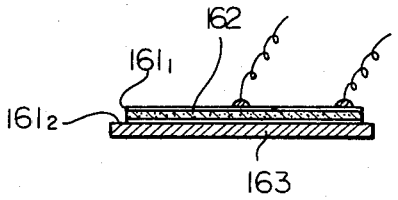
FIG. 7*b* is a section along a line VIIB—VIIB of FIG. 7*a;*
Figure 8A:
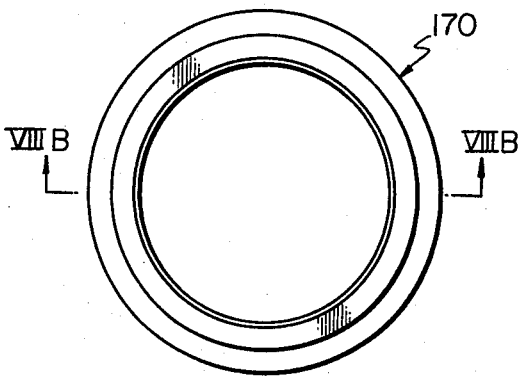
FIG. 8*a* is a plan view of a ring.
Figure 8B:
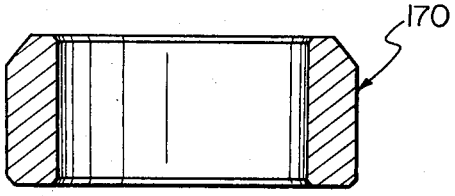
FIG. 8*b* is a section along a line VIIIB—VIIIB of FIG. 8*a;*
Figure 9A:
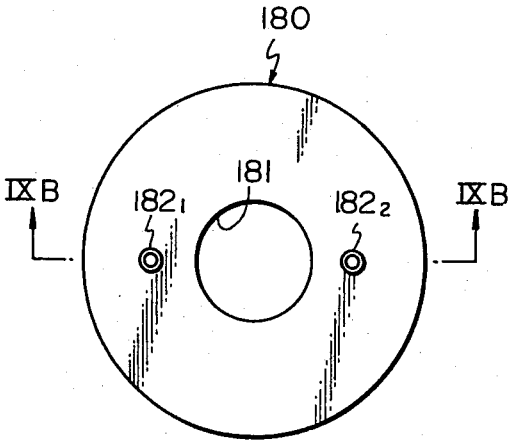
FIG. 9*a* shown an insulating plate in plan view.
Figure 9B:
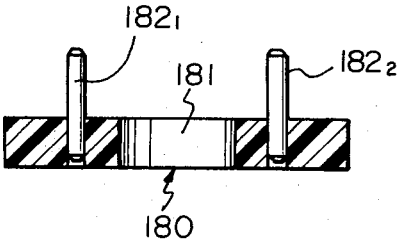
FIG. 9*b* is a section along a line IXB—IXB of FIG. 9*a;*
Figure 10A:
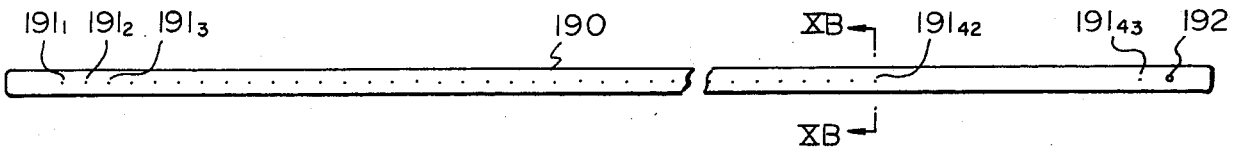
FIG. 10*a* is a plan view of a nozzle plate.
Figure 10B:
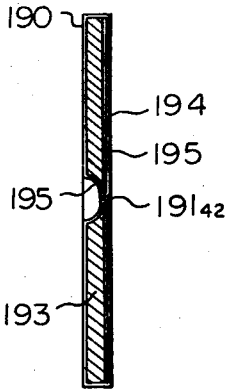
FIG. 10*b* is an enlarged section along a line XB—XB of FIG. 10*a;*

FIG. 7*a* illustrates in plan view an electrostrictive vibrator 160 accommodated in each of the chambers 144 of the body 140. FIG. 7*b* is a section along a line VIIB—VIIB of FIG. 7*a*. As shown, an electrostrictive vibrator 160 comprises a disc-like piezoelectric element 162 having first and second electrodes $161_1$ and $161_2$ vacuum-deposited on its front and rear surfaces. The electrode $161_2$ on the rear surface is turned over to the front surface of the piezoelectric disc 162 to constitute an electrode $161_2a$. A vibrating plate 163 is bonded to the rear electrode $161_2$ on the piezoelectric disc. Such seven electrostrictive vibrators $160_1$–$160_7$ are individually received in the chambers $144_1$–$144_7$ of the body 140. FIG. 8*a* indicates a ring 170 in a plan view and FIG. 8*b* shows it in a section along a line VIIIB—VIIIB of FIG. 8*a*. Seven such rings $170_1$–$170_7$ are press fitted in the chambers $144_1$–$144_7$ such that their lower ends hold the edges of the individual vibrating plates 163 and, in this way, securely position the vibrators $160_1$–$160_7$ within the chambers $144_1$–$144_7$. Annular insulating plates 180 are placed on the respective rings $170_1$–$170_7$. One of these rings 170 is shown in plan view in FIG. 9*a* and in section along a line IXB—IXB of FIG. 9*a* in FIG. 9*b*. Leads of each vibrator 160 are drawn out through the opening 181 of the insulating plate 180 and wound around conductive pins $182_1$ and $182_2$ individually. The reference numeral 183 denotes an adhesive injected into the opening 181 of the insulating plate 180. A nozzle plate 190 is snugly received in and connected securely to the slot 148 on the front of the body 140 by brazing or welding. FIG. 10*a* shows the nozzle plate 190 in a plan view while FIG. 10*b* shows it in an enlarged section along a line XB—XB of FIG. 10*a*. The nozzle plate 190 is formed with minute holes $191_1$–$191_{43}$ for ink ejection in registry with the radial centers of the individual passageways 142 of the body 140. The nozzle plate 190 also has an opening 192 which aligns with the blind hole 152 of the body 140 and has the same diameter as the blind hole 152. The nozzle plate 190 is produced by forming a resist film on each of the front and rear surfaces of a phosphor bronze plate 193, removing the resist film on the front surface by etching except for those portions corresponding to the holes $191_1$–$191_{43}$ and 192, plating the thus etched front surface with nickel as at 194, etching the rear surface to form holes which pierce through the phosphor bronze plate 193 to the nickel plating 194, removing the entire resist layers, and plating the opposite surfaces of the plate 193 with nickel as at 195. The nozzle plate 190 thus prepared by repeated etching and nickel plating is positioned within the slot 148 of the body 140 by inserting a pin into its opening 192 and the blind bore 152 of the body 140, followed by brazing or welding of the nozzle plate 190 to the walls of the slot 148. Where brazing is employed, a brazing agent will be applied in advance onto the rear surface of the nozzle plate 190 by printing (ring pattern application). In the illustrated embodiment, the holes $191_1$–$191_{42}$ are spaced a common distance of 5 mm whereas the hole $191_{43}$ is spaced 45 mm from the hole $191_{42}$. As will be described, the holes $191_1$–$191_{42}$ eject ink for the recording operation while the hole $191_{43}$ ejects ink which clears a recording sheet and serves for the detection of the amount of deflection necessary for monitoring the recording operation.

The open ended bores $147_1$ and $147_2$ at the opposite ends of the body 140 have O-rings therein and also have hollow screws $101_8$ and $101_9$ similar to the hollow screws $101_1$–$101_7$ press fitted therein. Pipes $103_8$ and $103_9$ are connected at one end to the hollow screws $101_8$ and $101_9$ individually through intermediate screws $102_8$ and $102_9$. These pipes $103_8$ and $103_9$ extend and are secured to the aforementioned manifold member 330.

In the head 100 having the above construction, ink chambers are defined by the elongate slot 141, openings $133_1$–$133_7$ and filtering chambers $131_1$–$131_7$. In a way, each filtering chamber 131 and its associated opening 133 constitute a branch ink chamber whereas the slot 141 constitutes a common ink chamber. In each of the branch ink chambers 131, 133, air stays in an upper portion of the bore 132, or in the passageway 134 communicated with the bore 132. Air in the common ink chamber 141 on the other hand stays in an upper portion of the slot 141, or at the level of the transverse passageways $146_1$ and $146_2$. Stated another way, the passageways 134 and 146 assume positions where air tends to stay in the respective ink chambers; the passageways 134 and 146 are communicated with the manifold member 330 by the corresponding pipes $103_1$–$103_9$.

Figure 11:
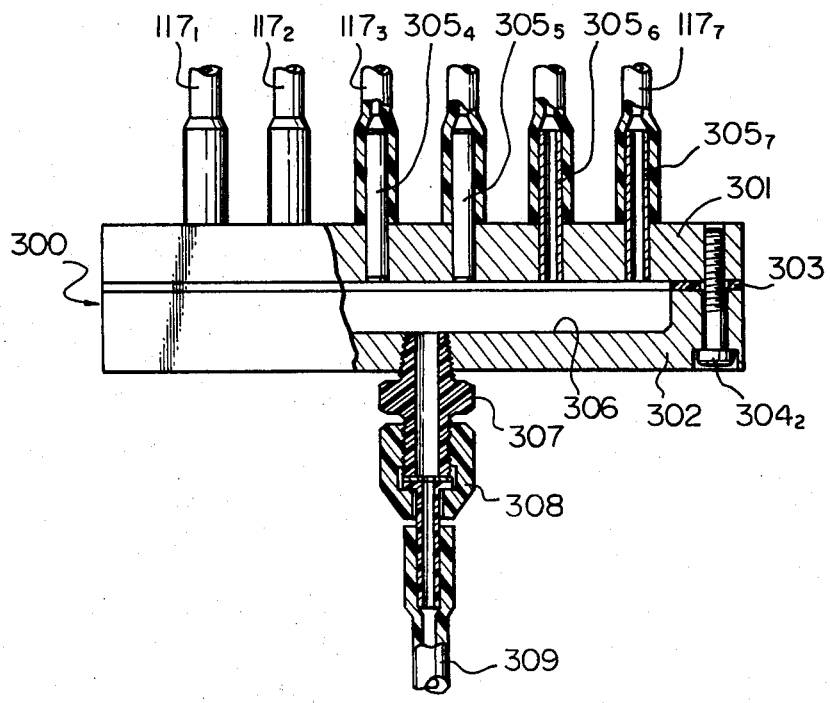
FIG. 11 is a partly cut away plan view of a manifold member.

A partly cut away plan view of the manifold member 300 is shown in FIG. 11. As shown, the manifold member 300 generally consists of first and second halves 301 and 302 which are connected together through a packing 303 by screws $304_1$ and $304_2$. The first half 301 has seven through passageways in which stainless steel pipes $305_1$–$305_7$ are press fitted individually. The pipes $117_1$–$117_7$ extending from the inlet block 110 are rigidly connected to the stainless steel pipes $305_1$–$305_7$. The second half 302 is formed with an elongate slot 306 which serves as a common ink passage. A tapered threaded opening is formed through a wall of the second half 302 into communication with the slot 306. A hollow screw 307 is screwed at one end in the tapered hollow screw mentioned above and at the other end with an intermediate screw 308. A pipe 309 has one end connected with the intermediate screw 308 and thus with the screw 307. The other manifold members 310, 320 and 330 have the same structure as that of the manifold member 300.

The recording apparatus also includes an electrode unit 200 located in front of the head 100. Generally the electrode unit 200 is made up of a frame 210, a charging electrode plate 220, a charge detecting electrode plate 230, shield electrode plates $240_1$ and $240_2$, a deflecting electrode unit 250, a connector 260 and a flexible flat cable 270.

Figure 12A:
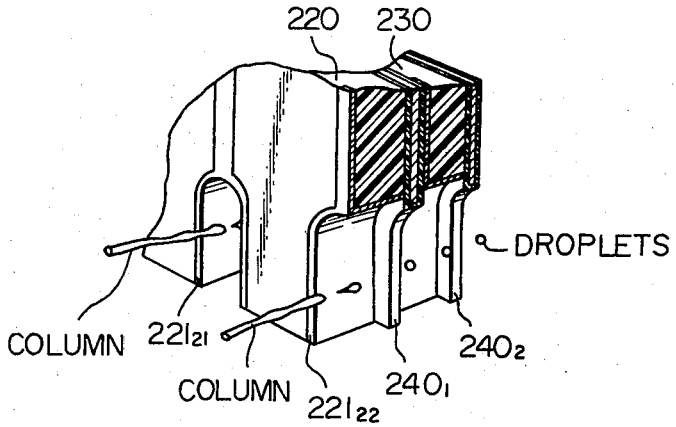
FIGS. 12*a* and 12*b* show in enlarged perspective different parts of an electrode unit.
Figure 12B:
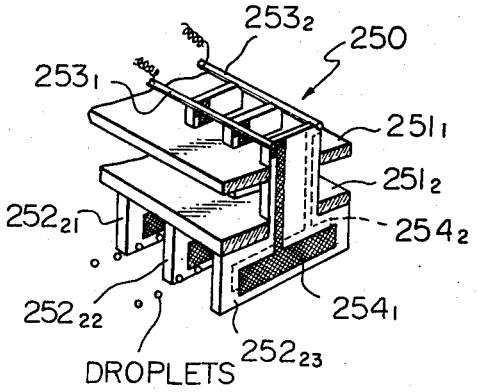

Lower parts of the electrode plates 220, 230, $240_1$ and $240_2$ are illustrated in enlarged perspective view in FIG. 12*a*. The deflecting electrode unit 250 inside the frame 210 is shown in enlarged fragmentary perspective view in FIG. 12*b*. All of the electrode plates 220, 230 and 240 have inverted U-shaped aligned recesses at their lower ends to permit passage of ejected ink therethrough. The charging electrode plate 220 has the inner walls of its openings covered with printed electrodes $221_1$–$221_{43}$ which function as charging electrodes. Each of the printed electrodes 221 extends along a surface of the electrode plate 220 to the upper end of the plate and, there, contacts a contactor provided to the connector 260. The charge detecting electrode plate 230 is designed in the same way as the charging electrode plate 220. Each of the shield plates $240_1$ and $240_2$ is prepared by forming insulating layers on the surfaces of a conductive plate perforated to have the forty-three inverted U-shaped recesses. These shield plates 240 are electrically connected with a shield potential (grounding) wire of the flexible flat cable 270. As will be discussed, the electrode unit 200 is designed to be lowered from its stand-by position to a predetermined recording position (FIG. 1) when necessary in order to prevent the electrode plates 220, 230 and 240 from being contaminated. The inverted U-shaped recesses of the electrode plates 220, 230 and 240 serve to avoid impingement of ink onto the electrode unit 200 during vertical movement of the electrode unit 200. The deflecting electrode unit 250 comprises two glass sheets $251_1$ and $252_2$, forty-five deflecting electrode plates $252_1$–$252_{45}$ and two conductive wires $253_1$ and $253_2$. The glass sheets $251_1$ and $251_2$ are rigidly connected to the frame 210 whereas the deflecting electrode plates $252_1$–$252_{45}$ are individually adhered to the glass sheets $251_1$ and $251_2$. Each of the electrode plates $252_2$–$252_{43}$ has deflecting electrodes $254_1$ and $254_2$ vacuum-deposited on its front and rear surfaces. Each of the other electrode plates $252_1$, $252_{44}$ and $252_{45}$ is provided with an electrode by vacuum deposition on only one of its surface. The electrode plates $252_1$–$252_{45}$ are respectively brazed to the wires $253_1$ and $253_2$. Screws $255_1$ and $255_2$ are in threaded engagement with opposite ends of the frame 210 at one end. A motor (not shown) is connected with the other or upper ends of the screws 255 so that the unit 200 is movable up and down through the screws 255 in accordance with forward and reverse rotations of motor (not shown).

A gutter 400 is located in front of the electrode unit 200. The gutter 400 has upright capturing pieces $421_1$–$421_{42}$ which stand in the paths of ink droplets to be ejected from the individual openings $191_1$–$191_{42}$ of the nozzle plate 190. The gutter 400 also has hood 430 adapted to capture all of the ink droplets which will be ejected from the opening $191_{43}$, whatever their flying path may be. An insulated wire 431 is rigidly connected to the hood 430 while its stripped conductor 432 is located in a position where ink droplets flying a specific path will impinge on the conductor. The reference numeral 500 indicates a recording sheet located in front of the gutter 400.

The pipe 309 extending from the manifold member 300 is connected with an outlet port of a normally closed electromagnetic valve 601. A pipe 602 extends from an inlet port of the valve 601 to one end of a pipe of a heater 603. The other end of the heater pipe is communicated by another pipe to a delivery port of an accumulator 610. The valve 601 comprises a plunger serving as a valve member, a coil spring adapted to bias the plunger to a valve closing position, and a coil for attracting the plunger to its valve opening position when energized. When this valve is de-energized, the plunger will interrupt the communication between the two valve ports. The accumulator 610 has an inlet port and an output port at its lower portion and has a thermistor 611 and a semispherical elastic film member 612 air-tightly therewith. An upper space inside the accumulator 610 is occupied by air. The thermistor 611 senses the temperature of ink stored in the accumulator 610 whereas the elastic film 612 is expansible in accordance with the pressure inside the accumulator 610. A strain gauge 613 is associated with the elastic film 612 such that its resistance varies with the movement of the elastic film. Stated another way, the elastic film 612 and strain gauge 613 constitute a pressure sensor in combination.

The inlet port of the accumulator 610 is communicated with a delivery port of a pump 620. This pump 620 is of the type which drives a cam for rotation with a motor 621 and causes a rod to reciprocate with the cam and a spring for thereby allowing a diaphragm rigid on the rod to reciprocate. A valving ball and a biasing coil spring are arranged in each of suction and delivery ports of the pump 620 to form a check valve. Rotation of the motor 621 causes the pump 620 to feed ink to the accumulator 610. The delivery pressure of the pump 620 will rise when the operating speed of the motor 621 is increased and fall when otherwise. A pipe 622 communicates the suction port of the pump 620 to one end of a filter 623, the other end of which is communicated with a lower portion of an ink reservoir 624. Let it now be assumed that the pump 620 has started its operation with the electromagnetic valve 601 kept closed. Ink is sucked from the ink reservoir 624 into the pump 620 and discharged from the pump 620 into the accumulator 610. The resultant increase in the amount of ink inside the accumulator 610 compresses the internal air whereby the ink pressure within the accumulator 610 is raised. When the coil of the valve 601 is energized to open the valve, the ink within the accumulator 610 is allowed to flow out of the accumulator 610 to the valve 601 by way of the pipe of the heater 603. From the valve 601 the ink advances to the manifold member 300 through the pipe 309 and therefrom to the head 100 through the individual pipes $\mathbf{117}_1$–$\mathbf{117}_7$. The ink admitted into the head 100 reaches the ejection openings $\mathbf{191}_1$–$\mathbf{191}_{43}$ of the nozzle plate 190 and is ejected therefrom to impinge on the capturing pieces $\mathbf{421}_1$–$\mathbf{421}_{42}$ and hood 430 of the gutter 400. Then the ink flows down into the gutter 400 and returns to the ink reservoir 624 via an outlet port 410 of the gutter and a pipe 411 extending from the gutter outlet 410 to the reservoir 624.

The manifold member 330 is communicated by a pipe 331 with an inlet port of a normally closed electromagnetic valve 625. The outlet port of the valve 625 is communicated by a pipe 626 with the ink reservoir 624. The pipe 626 extends into the interior of the reservoir 624. The valve 625 is constructed in the same way as the valve 601 as discussed. When the valve 625 has its coil energized, it is opened so that ink outgoes the bores 132 of the filter bracket 130 and the slot 141 of the body 140. These outgoing flows of ink of directed back to the reservoir 624 by way of the manifold member 330, pipe 331, valve 625 and pipe 626 successively. If any air is present within the bores $\mathbf{132}_1$–$\mathbf{132}_7$ or the slot 141, it will be admitted in the reservoir 624 together with the ink. That is, air is expelled from the bores $\mathbf{132}_1$–$\mathbf{132}_7$ and the slot 141. If desired, the pipe 626 may have its end remote from the valve 625 inserted in the gutter 400 to discharge the ink from the bores 132 and slot 141 into the gutter 400.

The manifold member 310 is communicated by a pipe 311 to the pipe of a second heater 630. The other end of the second heater pipe connects to a delivery port of a second pump 631 whose suction port is in turn communicated with an outlet port defined in a lower portion of a reservoir 632 for a heat-exchanging liquid. A pipe 321 extends from the manifold member 320 into the liquid reservoir 632 through an inlet port formed on the top of the liquid reservoir. When the pump 631 is operated, the heat-exchanging liquid is pumped out of the reservoir 632 and recirculated back thereto through the path defined by the pipe of the heater 630, manifold member 310, pipes $\mathbf{129}_1$–$\mathbf{129}_{13}$, bores $\mathbf{123}_{11}$–$\mathbf{123}_{74}$, pipes $\mathbf{129}_2$–$\mathbf{129}_{14}$ and manifold member 320. When the heater 630 is made operative, the liquid flowing through the heater 630 is heated. At the head 100, this heated liquid heats the heat-exchanging block 120 in the course of its flow through the bores 123 whereby the ink passing through the bores 122 is heated. The thermistor 150 (FIG. 6*a*) is adapted to sense the temperature of the ink inside the slot 141.

The thermistors 150 and 611 are electrically connected with a temperature control unit 640. The temperature control unit 640 compares the temperatures detected by the thermistors 150 and 611 with reference to target levels applied thereto from a central control unit (not shown) and thereby controls the value of current to be supplied to the heaters 603 and 630 and the operating speed of the pump 631. The ink temperature $T_{ink}$ at the slot 141 sensed by the thermistor 150 is processed into a digital signal and delivered to the central control unit.

The electromagnetic valves 601 and 625, pump 621 and strain gauge 613 are electrically connected with a pressure control unit 650. The central control unit supplies the pressure control unit 650 with a reference or target accumulator pressure and open-close commands for the valves 601 and 625. The pressure control unit 650 controls the operating speed of the motor 621 to equalize the actual pressure $P_{ac}$ sensed by the strain gauge 613 with a target pressure and, in response to a command from the central control unit, energizes or de-energizes the valves 601 and 625. The actual pressure $P_{ac}$ inside the accumulator 610 is also converted into a digital signal and coupled to the central control unit.

A print control unit 660 supplies charging voltages (pulses) and a deflecting voltage (constant voltage) to the charging electrode plate 220 and the conductive wires $\mathbf{253}_1$ and $\mathbf{253}_2$ connected with the individual deflecting electrode plates 252, respectively, through the flat cable 270, connector 260 and a cable (not shown). The charge detecting electrode 230 couples a charge detection signal (pulse) to the print control unit 660 by way of the flat cable 270 and connector 260. The insulated wire 431 is also connected with the print control unit 660. The print control unit 660 feeds a drive voltage of a constant frequency to the electrostrictive vibrators 160. The central control unit supplies the print control unit 660 with various control commands, timing pulses and image signals while the print control unit 660 supplies the central control unit with status signals (timing pulses) which are different from those coupled thereto from the central control unit. Operation of the print control unit 660 will be briefly described hereinafter.

When the power source is turned on, the print control unit 660 turns on its internal power sources successively according to a predetermined sequence and awaits the arrival of a command signal. As a drive signal is supplied to the unit 660, it starts driving the electrostrictive vibrators 160 with a predetermined period and a predetermined amplitude. When a phase search command is coupled thereafter, the unit 660 searches for a charging phase or a driving phase for droplets of ink from the individual ejection ports 191 on a port-by-port basis. Thus, a proper charging or driving phase is determined for each of the ejection ports 191. Then the unit 660 checks whether charged ink droplets have impinged on the stripped conductor 432 of the wire 431. If not, the unit 660 shifts the general charging voltage levels or the deflecting voltage level until the impingement occurs. Then the unit 660 supplies the deflecting electrode plates 252 with a deflecting voltage while informing the central control unit of the end of phase search. Thereafter, droplets from the election port $\mathbf{191}_{43}$ are charged with a predetermined phase and a predetermined level and, at the same time, monitored as to whether they are impinging on the conductor 432. When such droplets fail to hit the conductor 432, an alarm is produced and, after recording one line of information, the charging for recording is interrupted to re-set the charging levels or the deflecting voltage level. As charged droplets from the port $\mathbf{191}_{43}$ come to impinge on the conductor 432 again, the unit 660 informs the central control unit of a restart of recording operation and records the next line and onward. In the illustrated embodiment, the ejection ports $\mathbf{191}_1$–$\mathbf{191}_{42}$ are arranged at a common distance of 5 mm and an ink droplet is assumed to be deflectable by 40 dots through the distance of 5 mm. Hence, the charging electrodes $\mathbf{221}_1$–$\mathbf{221}_{42}$ are sequentially and repeatedly applied with forty charging pulses of different levels. The charging electrode for charging ink droplets from the ejection port $\mathbf{191}_{43}$ is constantly applied with a given level of charging pulses repeatedly. In this way, the ejection port $\mathbf{191}_{43}$ independent of the others $\mathbf{191}_1$–$\mathbf{191}_{42}$ for printing is allotted for a monitoring purpose. Ink droplets from this port $\mathbf{191}_{43}$ are always charged to a predetermined level and the conductor 432 monitors their proper deflection. The charging level for ink droplets from each of the ejection ports $\mathbf{191}_1$–$\mathbf{191}_{42}$ is compensated by shifting it with reference to the charging voltage level obtained by the deflection level search, or the proper deflection voltage determined by the deflection level search is employed as a voltage on the deflecting electrode plates $\mathbf{252}_1$–$\mathbf{252}_{43}$. Hence, the deflecting level for ink droplets from each of the ports $\mathbf{191}_1$–$\mathbf{191}_{42}$ is determined adequately and quickly.

When informed of the end of the phase searching and setting, the central control unit supplies the print control unit 660 with an image signal line by line. Based on the image signal, the unit 660 couples charging voltage pulses to the electrodes $\mathbf{221}_1$–$\mathbf{221}_{42}$.

The phase searching and setting and the printing are carried out with the electrode unit 210 lowered to a predetermined position after the ink temperature $T_{ink}$ and ink pressure $P_{ac}$ have been stabilized within predetermined ranges.

Figures 1, 13A:
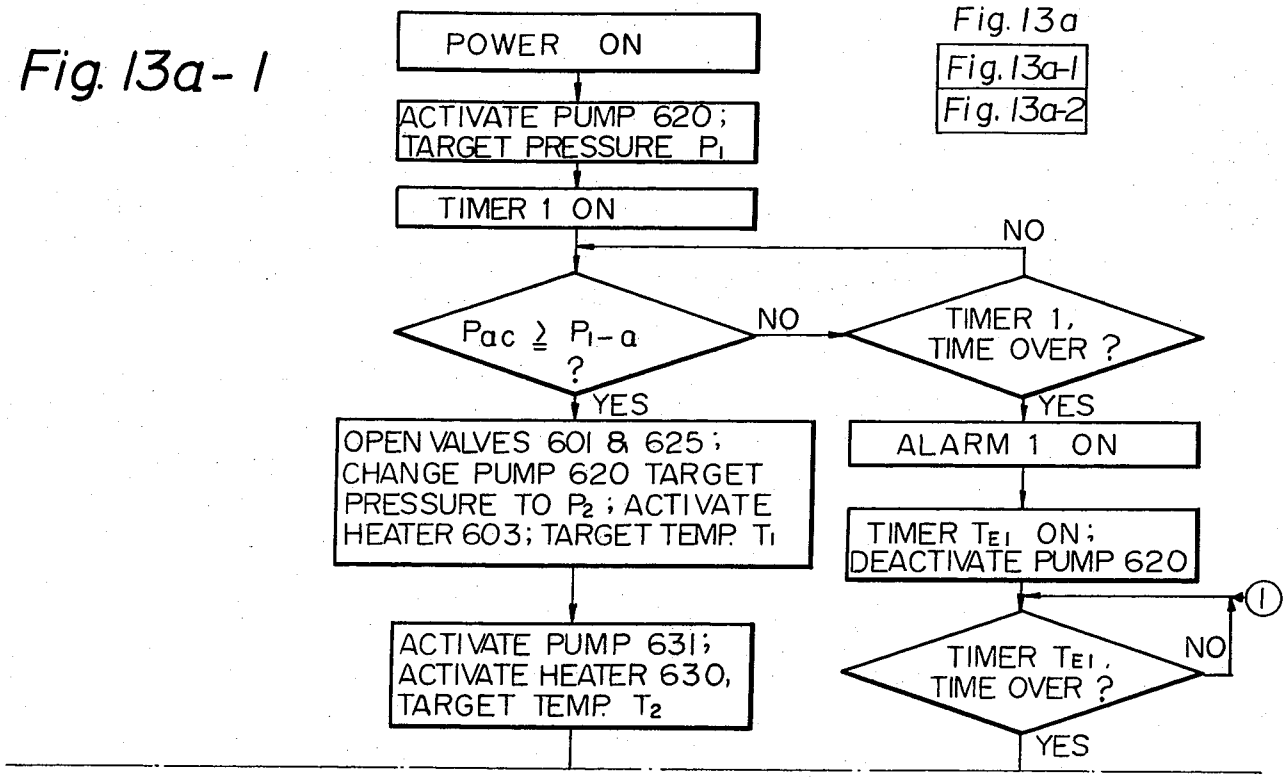
FIGS. 13*a* and 13*b* are flow charts demonstrating the manner of controlling the actions of the arrangement shown in FIG. 1.
Figures 2, 13A:
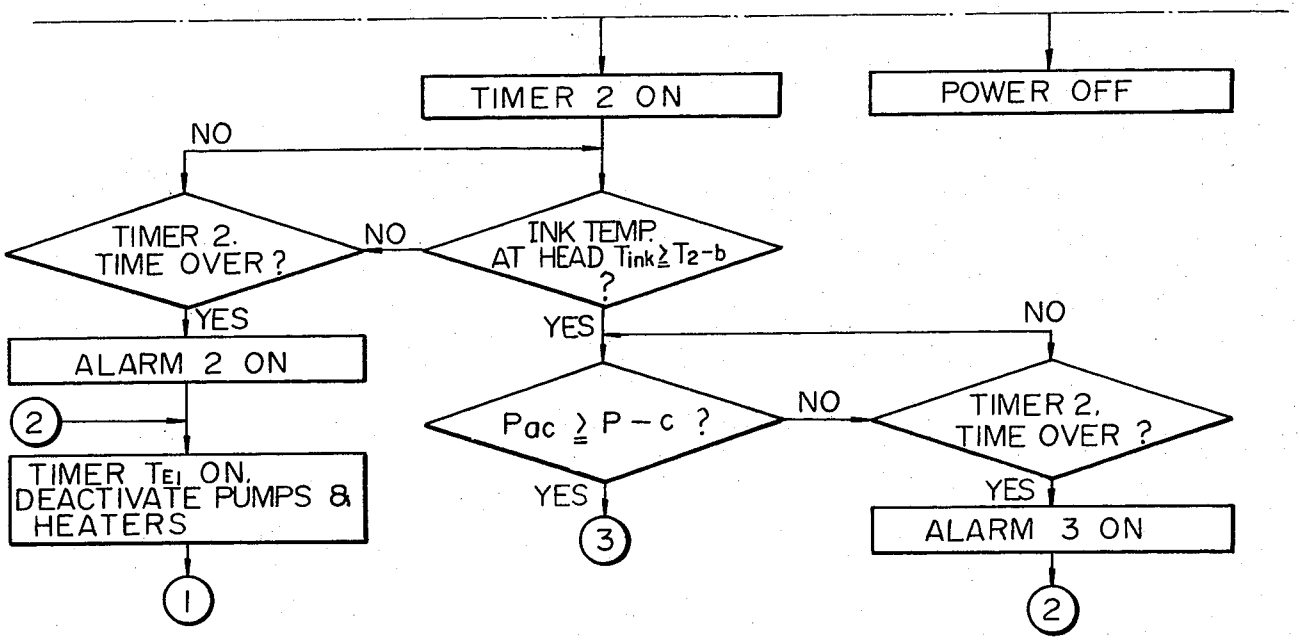
Figures 1, 13B:
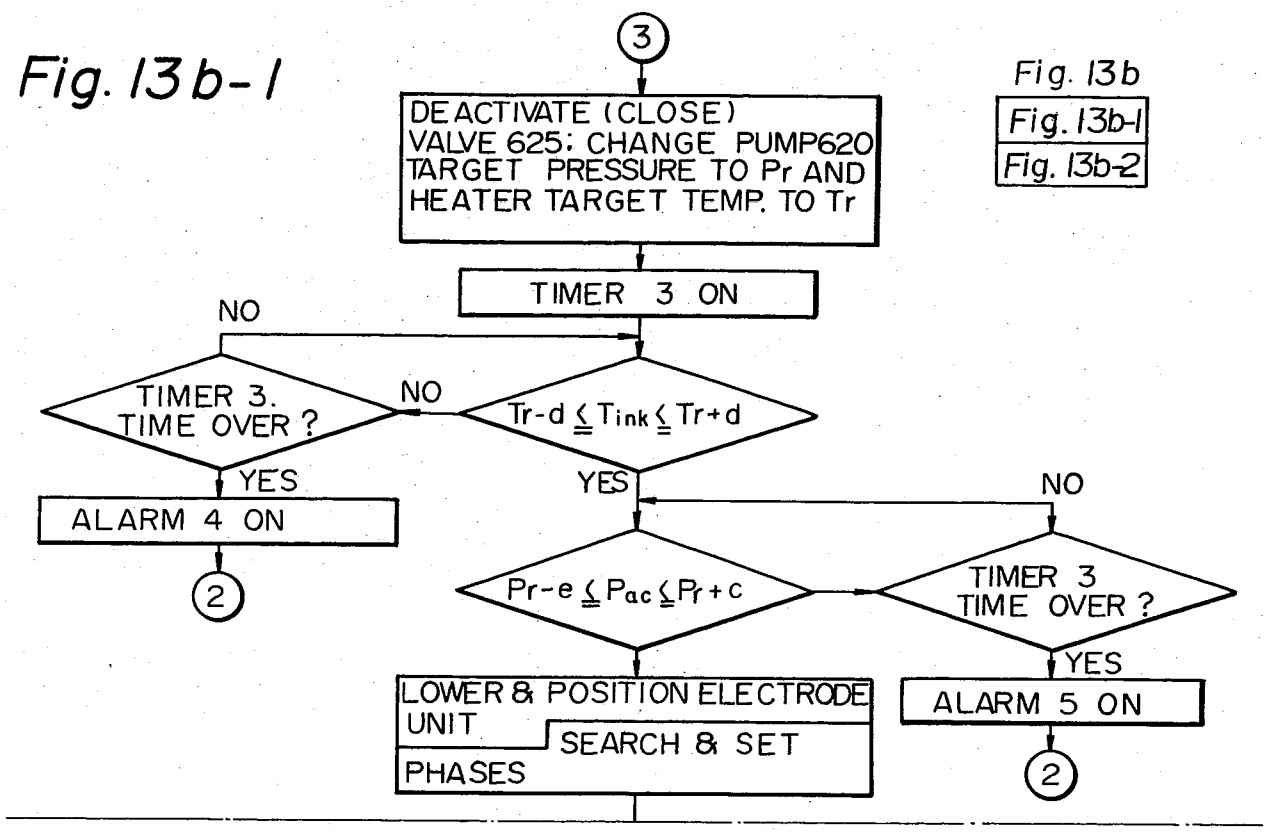
Figures 2, 13B:
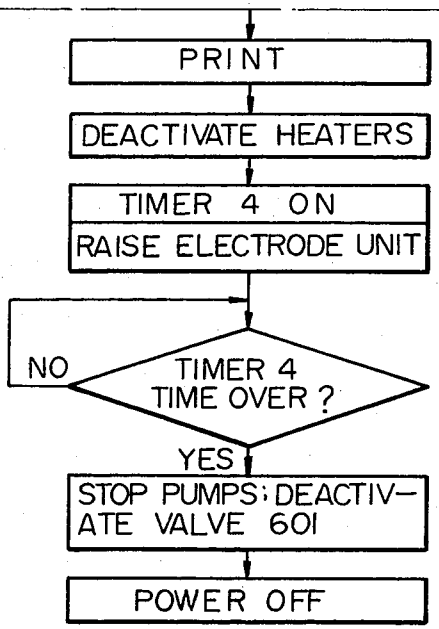
Figure 13C:
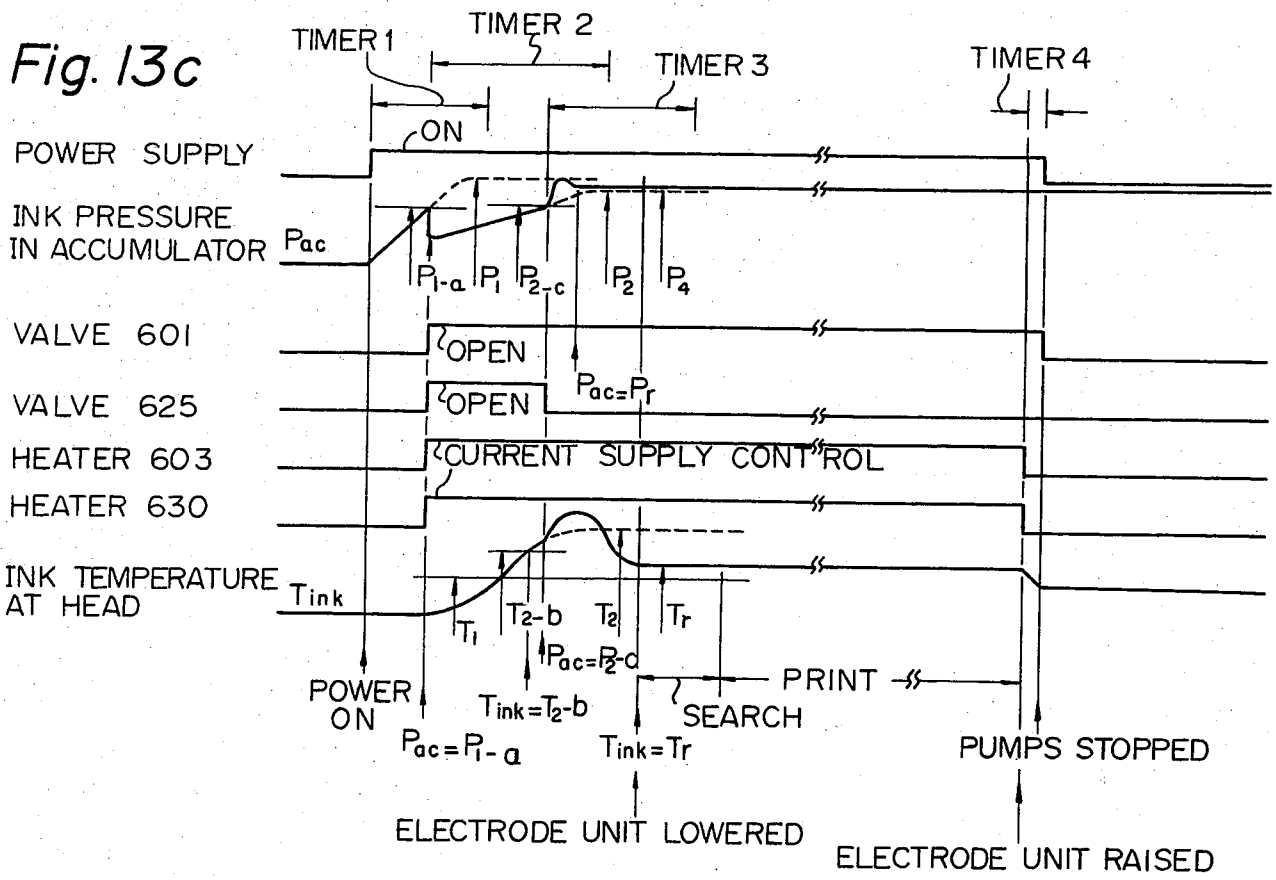
FIG. 13*c* is a timing chart showing an interrelation between various actions.
Figure 14:
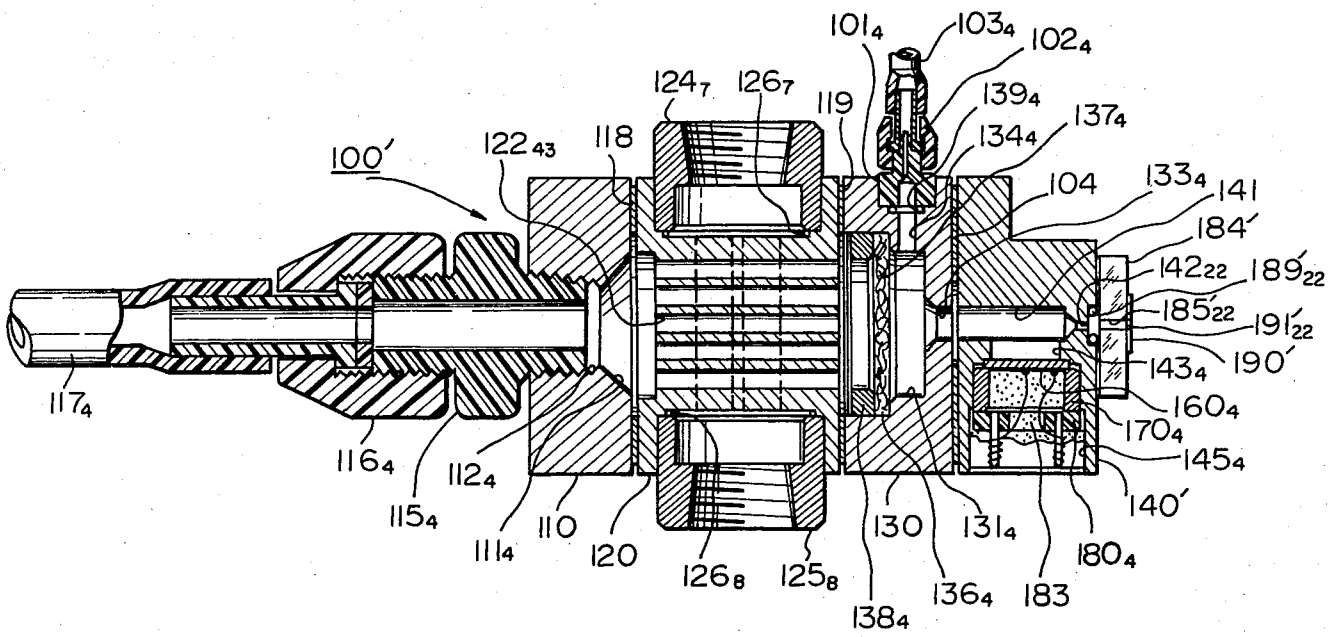
FIG. 14 shows a modification of FIG. 2.

Reference will now be made to FIGS. 13*a*–13*c* for describing operations of the individual sections which will proceed in response to various commands coupled thereto from the central control unit until the ink pressure $T_{ink}$ and ink pressure $P_{ac}$ become stable. When a main power source is turned on, the central control unit turns on power sources of the temperature control unit 640, pressure control unit 650 and print control unit 660. Then each of these units 640, 650 and 660 turns on its internal power sources according to a predetermined sequence. Thereupon, the central control unit supplies the pressure control unit 650 with a command for driving the pump 620 and with a target pressure (maximum pressure) $P_1$. The pressure control unit 650 thus drives the pump 620 and, by comparing the actual pressure $P_{ac}$ sensed by the strain gauge 613 with the target level $P_1$, controls the pump operation so that the actual pressure $P_{ac}$ equals the target pressure $P_1$. Monitoring an output code of the unit 650 indicative of the pressure $P_{ac}$, the central control unit delivers a command for opening the valves 601 and 625 to the pressure control unit 650 when the actual pressure $P_{ac}$ becomes larger than or equal to ($P_1$- a) where a is a constant. Simultaneously, the target value $P_1$ coupled from the central control unit to the pressure control unit 650 is replaced by another target value $P_2$. The central control unit also supplies the temperature control unit 640 with a command for controlling the heating operation of the heater 603 and with a target temperature $T_1$ for the control. Further coupled from the central control unit to the temperature control unit 640 are a command for activating the heater 630 and a target temperature $T_2$ for the heater 630. The pressure control unit 650 energizes and thereby opens the valves 601 and 625 and changes its control mode for the pump 620 such that the actual pressure $P_{ac}$ becomes equal to the second target pressure $P_2$. The temperature control unit 640 performs a feed forward control on the heater 603 so that the ink temperature $T_{ac}$ sensed by the thermistor 611 rises to the target temperature $T_1$. Simultaneously, the unit 640 controls the heating operation of the heater 630 by the combination of a feed forward control for raising the temperature $T_1$ to the temperature $T_2$ and a feedback control for applying a difference between the temperature $T_{ink}$ sensed by the thermistor 150 and the target temperature $T_2$, ($T_2-T_{ink}$), as an error signal to the feed forward control. With the valves 601 and 625 thus opened, ink is ejected from the ports $\mathbf{191}_1$–$\mathbf{191}_{43}$ and, at the same time, air and ink in the bores $\mathbf{132}_1$–$\mathbf{132}_7$ and slot 141 flow into the ink reservoir 624 through the pipes $\mathbf{103}_1$–$\mathbf{103}_9$, manifold member 330, pipe 331, valve 625 and pipe 626. This flow of air and ink into the reservoir 624 causes the pressure $P_{ac}$ in the accumulator 610 to fall. The operating speed of the pump 620 is increased to compensate for such a fall of the pressure $P_{ac}$, raising the pressure $P_{ac}$ progressively. The heater 603 heats the ink flowing therethrough toward the head 100 while the heat-exchanger block 120 further heats the heated ink within the head 100. In this embodiment, the heater 603 is designed to heat ink up to the temperature $T_1$ and the heater 630 to heat it with the temperature $T_2$ as a target.

The central control unit monitors the temperature $T_{ink}$ sensed by the thermistor 150. When this temperature $T_{ink}$ becomes higher than or equal to ($T_1-b$) where b is a constant, the central control unit checks the actual ink pressure $P_{ac}$ in the accumulator 610. As the pressure $P_{ac}$ becomes higher than or equal to ($P_2-c$) where c is a constant, the central control unit supplies the pressure control unit 650 with a command for closing the valve 625 and with a third target pressure $P_r$ which replaces the target pressure $P_2$. The central control unit also replaces the target temperature $T_2$ delivered to the temperature control unit 640 with a third target pressure $T_r$. Then the pressure control unit 650 closes the valve 625 and so controls the pump 620 as to make the actual pressure $P_{ac}$ equal to the target pressure $P_r$. The temperature control unit 640 on the other hand performs a heating control for equalizing the temperature $T_{ink}$ with the temperature $T_r$, that is, a constant temperature heating control in which a feed forward control for equalizing the temperature $T_1$ with temperature $T_r$ is compensated by a feedback control with a temperature difference ($T_r-T_{ink}$).

Thereafter, the central control unit monitors the temperature $T_{ink\ and\ pressure\ Pac}$. As the relations $T_r-d \leqq T_{ink} \leqq T_r+d$ and $P_r-e \leqq P_{ac} \leqq P_r+e$ come to hold, meaning that the ink temperture $T_{ink}$ and ink pressure $P_{ac}$ have reached allowable ranges which are the control ranges of the temperature control unit 640 and pressure control unit 650 individually, the central control unit instructs an electrode elevation control unit (not shown) to lower the electrode unit 200 to a predetermined recording position. When the electrode unit 200 is fully lowered to the recording position, the central control unit commands the print control unit 660 to perform a phase search. After searching and setting phases and setting an amount of deflection, the print control unit requests the central control unit to deliver image signals and carries out recording actions.

Upon completion of the recording actions, the central control unit instructs the temperature control unit 640 to de-energize the heaters 603 and 630 and the electrode elevation control unit to raise the electrode unit 200 out of the recording position. After the lapse of a given period of time, the central control unit supplies the pressure control unit 650 with a command for closing the valves 601 and 625 and deactivating the pumps 620 and 631.

The procedure discussed hereinabove may be summarized as follows. In a preparatory stage, the pump 620 is first driven to pressurize the interior of the accumulator 610. As the accumulator pressure reaches a given reference level, the valves 601 and 625 are opened and the heaters 603 and 630 and pump 631 are activated. Under this condition, ink is caused to circulate while being heated and air inside the ink chambers is discharged into the ink reservoir together with ink. In this instance, because the valve 625 is in its open position, the ink pressure at the slot 141 is low enough to avoid spraying of ink through the ejection ports $\mathbf{191}_1$–$\mathbf{191}_{43}$. When the ink temperature at the slot 141 rises beyond a reference level, the valve 625 is closed so that the ink pressure at the slot 141 is raised to permit ink to be ejected out of the ejection ports $\mathbf{191}_1$–$\mathbf{191}_{43}$. However, the ink is prevented from spraying since air in the ink chambers has been entirely expelled. As the temperature $T_{ink}$ and pressure $P_{ac}$ of the ink reach their predetermined ranges, the electrode unit 200 is lowered to its recording position. Then a phase search is started and a recording operation is carried out. The ink is heated at two different stages by the independent heaters 603 and 630 in order to have its temperature $T_{ink}$ stabilized within a narrow range. Accordingly, the amount of temperature elevation and the fluctuable range at each stage are relatively small. For this reason and because an error at the first stage is absorbed at the second stage, fluctuation in the ink temperature is minimized.

In the embodiment described, the heater 603 takes charge of a constant temperature feed forward preheating control to the target level $T_1$ whereas the heater 630 is in charge of the combination of a feed forward temperature elevation control from the target level $T_1$ to the target level $T_r$ and a feedback control for an error $(T_r - T_{ink})$. There may be employed an alternative arrangement in which the second temperature elevation system made up of the heater 630, heat-exchanging liquid and heat-exchanger block is considered as a thermal filter or a thermal damper and the heater 630 is supplied with a constant current corresponding to the variable ambient temperature while the heater 603 performs feedback control for absorbing a difference between the temperature $T_{ink}$ and target level $T_r$. In this case, temperature fluctuation within a short period of time will be absorbed by the thermal filter making the temperature fluctuation flat.

While the recording apparatus has been shown and described as comprising seven sets of ink paths leading to the slot 141, it suffices in the most simplified arrangement to provide one set or a few sets of such paths. Where the number of the path sets is only one, the manifold members 300, 310 and 320 are needless. A modification to the apparatus of FIG. 1 will be discussed in this paragraph in connection with one set of ink paths. In the modification, the inlet block 110 is formed with a slot while the heat-exchanger block 120 has slots formed on the top and bottom thereof in communication with the through bores $\mathbf{123}_{11}$–$\mathbf{123}_{74}$. The filter bracket 130 has a slot extending throughout the filter bracket from the front to the rear. The upper wall of the slot of the filter bracket 130 is tapered toward one hole formed throughout the upper wall such that ink is expelled to the valve 625. A filter complementary in shape to the section of the slot of the filter bracket 130 is accommodated in said slot. Furthermore, the slot 141 of the body 140 has its ink inlet end made wider and is tapered to promote the flow of air therein toward the slot of the filter bracket 130. In this case, the passageways $\mathbf{146}_1$ and $\mathbf{146}_2$ communicating with the slot 141 are needless.

In another modification to the apparatus of FIG. 1, the through bores $\mathbf{122}_{11}$–$\mathbf{122}_{75}$ of the heat-exchanger block 120 may form an array or arrays along lateral central axis of the block 120 and sandwitched between upper and lower through passages extending in parallel with the array or arrays of the through bores $\mathbf{122}_{11}$–$\mathbf{122}_{75}$. With this design, one of the upper and lower through passages will be communicated with the pipe of the heater 630.

While the present invention has been shown and described in connection with specific embodiments, it is similarly applicable any other deflection control type ink jet recording apparatus which ejects pressurized ink from an ejection port or ports.

An improved version of the ink jet or ejection head 100 is shown in FIGS. 14 and 15*a* to 15*g*, with like elements designated by the same reference numerals and modified but corresponding elements designated by the same reference numerals primed.

A thick flat glass plate 184' is securely connected to the front end of the body 140'. The glass plate 184' is shown in plan view in FIG. 15*a*, in section along a line XVB—XVB of FIG. 15*a* in FIG. 15*b* and in section along a line XVC—XVC of FIG. 15*a* in FIG. 15*c*. As shown, the glass plate 184' has openings $\mathbf{185'}_1$–$\mathbf{185'}_{43}$ in alignment with the passageways $\mathbf{142}_1$–$\mathbf{142}_{43}$ of the body 140' and through bores $\mathbf{187'}_1$–$\mathbf{187'}_{38}$ on opposite sides of the openings $\mathbf{185'}_1$–$\mathbf{185'}_{43}$ to receive connecting screws. Additionally, the glass plate 184' has in its front a series of blind holes $\mathbf{186'}_1$–$\mathbf{186'}_{24}$ for positioning nozzles plates. The front and rear surfaces of the glass plate 184' are machined flat by a double-end grinder after being formed with the blind holes $\mathbf{186'}_1$–$\mathbf{186'}_{24}$. As viewed in FIG. 15*d*, the individual through bores $\mathbf{187'}_1$–$\mathbf{187'}_{38}$ have therein metal bushings or rings $\mathbf{188'}_1$–$\mathbf{188'}_{38}$ each having an outside diameter smaller than the inside diameter of the bores 187', such that the rear surface of the glass plate 184' is held at a short distance (2/100 mm to 3/100 mm) from a flat surface of the body 140'. The metal rings 188' are secured in the corresponding bores 187' by an adhesive with their bottoms contacted with the flat surface. In this instance, the adhesive penetrates into the gap between each metal ring 188' and the wall of the corresponding bore 187'.

Figure 15A:
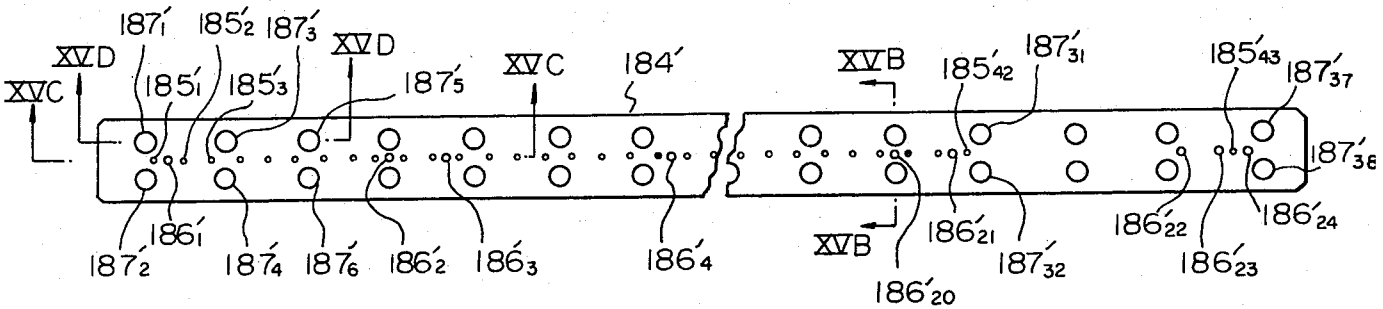
FIG. 15*a* shows a glass plate in plan view.
Figure 15B:
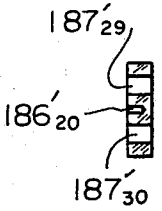
FIG. 15*b* is a section along a line XVB—XVB of FIG. 15*a;*
Figure 15C:
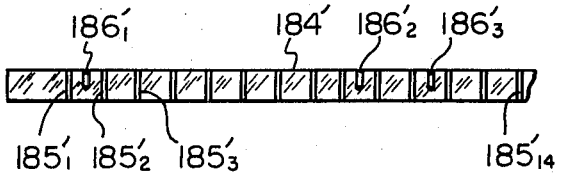
FIG. 15*c* is a section along a line XVC—XVC of FIG. 15*a;*
Figure 15D:
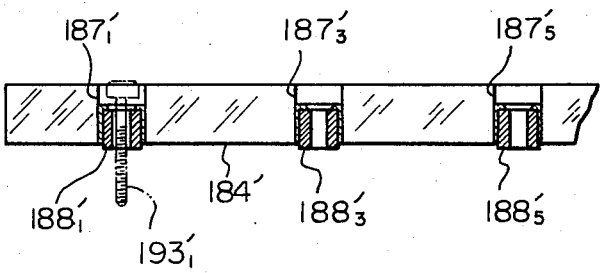
FIG. 15*d* is an enlarged section along a line XVD—XVD of FIG. 15*a* and shows the glass plate with metal rings attached thereto.
Figure 15E:
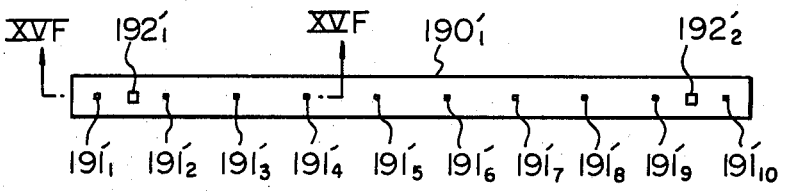
FIG. 15*e* shows a nozzle plate in enlarged plan view.
Figure 15F:
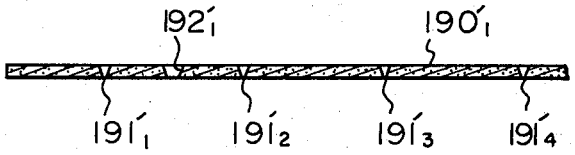
FIG. 15*f* is a section along a line XVF—XVF of FIG. 15*e;*
Figure 15G:
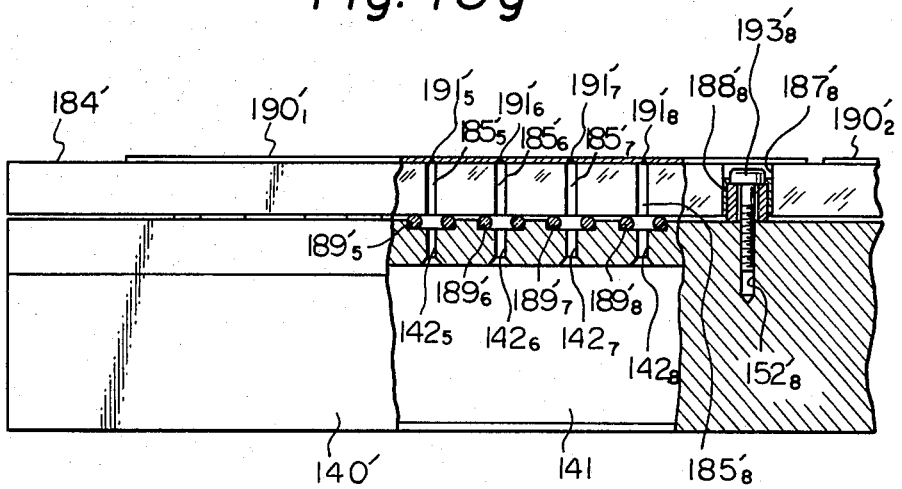
FIG. 15*g* shows in plan view the body with the glass plate connected thereto, a central portion being a section along ink ejection ports and a right-hand portion being a section along screw-threaded holes.

FIG. 15*e* shows one 190'$_1$ of nozzle plates in an enlarged rear plan view. FIG. 15*f* is a section taken along a line XVF—XVF of FIG. 15*e*. The nozzle plate 190'$_1$ comprises a mirror-finished monocrystalline thin flat plate or wafer of silicone having a thickness of 0.3 mm. This silicone wafer is etched to have ten equidistant quadrilateral openings 191'$_1$–191'$_{10}$ which serve as ink ejection ports and are 18 μm long at one side at the front. The silicone wafer is also etched to have openings 192'$_1$ and 192'$_2$ at opposite end portions of the array of the ink ejection ports. These openings 192' are conjugate to the blind 186' of the glass plate 184' and join in positioning of the silicone wafer relative to the glass plate 184'. Since in this embodiment the nozzle plate 190' has forty-two ejection ports 191'$_1$–191'$_{42}$ for recording and one ejection port 191'$_{43}$ for monitoring, five silicone wafers 190'$_1$–190'$_5$ having the same design are employed as nozzle plates. The silicone wafer 190'$_1$ is for example bonded to the surface of the glass plate 184', which has the metal rings 188'$_1$–188'$_{38}$ rigidly therein, with its openings 192'$_1$ and 192'$_2$ aligned individually with the blind holes 186'$_1$ and 186'$_2$ of the glass plate 184'. For this bonding, there may be employed a eutectoid bonding process, a soldering, adhesion with epoxy resin, welding, diffusion or solid phase anodic oxidation. As shown in FIG. 15*g*, the glass plate 184' thus carrying the silicone wafers 190'$_1$–190'$_5$ is rigidly mounted to the body 140' by placing O-rings 189'$_1$–189'$_{43}$ in the circular recesses 148'$_1$–184'$_{43}$ and passing screws 193'$_1$–193'$_{38}$ through the individual metal rings 188'$_1$–188'$_{38}$ and driving them into screw-threaded holes 152'$_1$–152'$_{38}$ of the body 140'. As will be noted, the metal rings 188' may be replaced by rubber rings or plastic rings. In this assembly of the glass plate 184' and body 140', the O-rings 189' are individually compressed to provide air-tight sealing between the glass plate 184' and body 140'. Because the metal rings 188'$_1$–188'$_{38}$ project or extend slightly external of the glass plate 184', the glass plate 184' is slightly spaced from the body 140'. In the illustrated embodiment, neighboring ones of the ink ejection ports 191'$_1$–191'$_{42}$ are spaced by 5 mm from each other while the ink ejection port 191'$_{43}$ is at a distance of 45 mm from the port 191'$_{42}$. Ink ejected from the ports 191'$_1$–191'$_{42}$ is utilized for recording whereas ink from the port 191'$_{43}$ clears the recording sheet and is used in the measurement of the amount of deflection for monitoring the recording conditions.

Various modifications will become possible for those skilled in the art after receiving the teachings of the present disclosure without departing from the scope thereof.

What is claimed is:

1. An ink jet printing apparatus including an ink ejection head having a chamber therein and at least one ink ejection port communicating with the chamber, an ink reservoir containing ink and pump means for pumping ink from the reservoir to the chamber, characterized by comprising;

a passageway communicating with the chamber;

valve means disposed in the passageway, the passageway leading from the chamber to the reservoir; and control means for opening the valve means at a start of operation of the apparatus to recirculate ink from the reservoir through the pump means, chamber and passageway back to the reservoir and subsequently closing the valve means, the passageway and said at least one ink ejection port being constructed such that, when the valve means is open, ink is not ejected from said at least one ejection port.

2. An apparatus as in claim 1, further comprising heater means for heating the ink, the control means closing the valve means when a temperature of the ink reaches a predetermined value.

3. An apparatus as in claim 2, in which the heater means comprises a heater disposed between the reservoir and the ink ejection head.

4. An apparatus as in claim 3, in which the heater means further comprises a heat exchanger connected to the ink ejection head, a pump for pumping heat exchange fluid through the heat exchanger and a heater for heating the heat exchange fluid.

5. An apparatus as in claim 4, further comprising temperature regulator means for regulating temperatures of the heaters for the ink and heat exchange fluid.

6. An ink ejection head including a block defining therein an ink chamber and being formed with a flat surface having a plurality of ink ejection passageways formed therethrough which communicate with the ink chamber, a thick flat plate being formed with ink ejection passageways therethrough conjugate to the ink ejection passageways of the flat surface, a thin flat plate fixed to the thick flat plate and being formed with ink ejection ports therethrough conjugate to the ink ejection passageways of the thick flat plate and fastener means for fastening the thick flat plate to the flat surface with the respective ink ejection passageways in alignment, a coefficient of thermal expansion of the thick flat plate being equal to a coefficient of thermal expansion of the thin flat plate.

7. A head as in claim 6, in which the thick flat plate is formed with mounting holes, the head further comprising bushings fixed in the mounting holes and extending external of the thick flat plate toward the flat surface and engaging therewith such that the thick flat plate is spaced from the flat surface by an amount of external extension of the bushings, the fastener means comprising screws which extend through the bushings for screwing the thick flat plate to the flat surface.

8. A head as in claim 7, further comprising resilient sealing rings disposed between the flat surface and the thick flat plate in a compressed state and sealingly surrounding the ink ejection passageways of the flat surface and thick flat plate.

9. A head as in claim 6, in which the thin flat plate is formed of a monocrystalline material.

10. A head as in claim 9, in which the thick flat plate is formed of a non-metallic material.

11. A head as in claim 6, in which the thin flat plate is formed of monocrystalline silicone and the thick flat plate is formed of glass.

12. A head as in claim 11, in which the ink ejection ports of the thin glass plate are formed equidistantly from each other by etching.

* * * * *